US010461455B2

(12) United States Patent
Liber et al.

(10) Patent No.: US 10,461,455 B2
(45) Date of Patent: Oct. 29, 2019

(54) ELECTRICAL CONNECTOR ASSEMBLY

(71) Applicant: Yazaki Europe Ltd, Hertfordshire (GB)

(72) Inventors: Danijel Liber, Varazdin (HR); Igor Jazvic, Zagreb (HR)

(73) Assignee: YAZAKI EUROPE LTD., Hertfordshrie (GB)

( * ) Notice: Subject to any disclaimer, the term of this patent is extended or adjusted under 35 U.S.C. 154(b) by 0 days.

(21) Appl. No.: 15/948,407

(22) Filed: Apr. 9, 2018

(65) Prior Publication Data

US 2018/0294591 A1 Oct. 11, 2018

(30) Foreign Application Priority Data

Apr. 10, 2017 (EP) ..... 17165755

(51) Int. Cl.

| | |
|---|---|
| ***H01R 13/53*** | (2006.01) |
| ***H01R 13/35*** | (2006.01) |
| ***H01R 13/26*** | (2006.01) |
| *H01R 13/15* | (2006.01) |
| *H01R 13/10* | (2006.01) |

(52) U.S. Cl.

CPC ..... *H01R 13/35* (2013.01); *H01R 13/26* (2013.01); *H01R 13/53* (2013.01); *H01R 13/10* (2013.01); *H01R 13/15* (2013.01)

(58) Field of Classification Search

CPC ..... H01R 35/04
USPC ..... 439/181
See application file for complete search history.

(56) References Cited

U.S. PATENT DOCUMENTS

| | | | | |
|---|---|---|---|---|
| 5,135,417 | A * | 8/1992 | Stanevich | H01R 13/03 439/851 |
| 6,382,998 | B2 * | 5/2002 | Miwa | H01R 13/6485 439/181 |
| 6,659,783 | B2 | 12/2003 | Copper et al. | |
| 8,215,992 | B1 | 7/2012 | Herrmann | |
| 8,613,626 | B1 * | 12/2013 | Phan | H01R 13/11 439/181 |

(Continued)

FOREIGN PATENT DOCUMENTS

| | | |
|---|---|---|
| EP | 1 445 839 A1 | 8/2004 |
| EP | 1 284 526 B1 | 1/2009 |

(Continued)

*Primary Examiner* — Phuong K Dinh
(74) *Attorney, Agent, or Firm* — Sughrue Mion, PLLC

(57) ABSTRACT

An electrical connector assembly including a first connector having a first main contact element and a first auxiliary contact element, the first auxiliary contact element being electrically connected to said first main contact element, and a second connector having a second main contact element and a second auxiliary contact element, the second auxiliary contact element being electrically connected to said second main contact element. The first and second connectors are mateable in a mating direction parallel to a longitudinal axis of the electrical connector assembly. The first and second main contact elements are configured to disconnect from each other before the first and second auxiliary contact elements disconnect from each other during unmating the first and second connectors. In a fully mated condition the first and second main contact elements are in contact and the first and second auxiliary contact elements are disconnected from each other.

11 Claims, 3 Drawing Sheets

(56) References Cited

U.S. PATENT DOCUMENTS

2003/0087542 A1 5/2003 Yamakawa et al.

FOREIGN PATENT DOCUMENTS

| | | | |
|---|---|---|---|
| JP | 2001-250610 | A | 9/2001 |
| JP | 2001-250647 | A | 9/2001 |
| JP | 2003-22869 | A | 1/2003 |

* cited by examiner

ELECTRICAL CONNECTOR ASSEMBLY

BACKGROUND OF THE INVENTION

Field of the Invention

The invention relates to an electrical connector assembly comprising a first connector having a first main contact element and a first auxiliary contact element, said first auxiliary contact element being electrically connected to said first main contact element. The electrical connector assembly further comprises a second connector having a second main contact element and a second auxiliary contact element, said second auxiliary contact element being electrically connected to said second main contact element. The first connector and the second connector are mateable in a mating direction parallel to a longitudinal axis of the electrical connector assembly. The first and second main contact elements are configured to disconnect from each other before the first and second auxiliary contact elements disconnect from each other during unmating the first and second connectors. Or, in other words, the first and second auxiliary contact elements are configured to contact each other before the first and second main contact elements contact each other during mating the first and second connectors.

Background

The first main contact element and the second main contact element are configured to carry electrical power between the first connector and the second connector when mated. In particular, in automotive systems 48 volts electrical systems are increasingly utilized. This voltage is, compared to state of the art 12 volt systems, increased and could cause significant electrical arcs when disconnecting the first and second main contact elements from each other.

To avoid electrical arcs connectors have been developed which can be mated and unmated when the electrical power is inactive. Such "cold mating" does not present problems with electrical arcs. However, in some applications the connectors need to be mated and unmated when the electrical power is active, i.e. while the first and second main contact elements are electrically energized ("hot mating"). In particular, when unmating this kind of connectors arcs occur between the first main contact element and the second main contact element in a first instance during unmating the first and second connectors when the main contact elements are not in contact anymore. However, due to the electronic arc electrical power is still transmitted through the arc between the first and second main contact elements, causing high temperatures and, hence, damages at the first and second contact elements.

An electrical connector as initially described is disclosed in U.S. Pat. No. 6,659,783 B2. This electrical connector can be unmated without previously disconnecting power from the connectors. The main contact elements and the auxiliary contact elements are shunted by a positive temperature coefficient resistor located between the first main contact element and the first auxiliary contact element. The first main contact element will be disconnected first and the auxiliary contact element can be longer than the main contact element. During unmating the connectors arcing will not occur at the main contact elements. The current will be shunted to the still connected longer auxiliary contact element when the main contact elements are just disconnected from each other. Heat, generated by the high electrical power shunted through the auxiliary contact elements, will increase the resistance in the positive temperature coefficient resistor. At the time the auxiliary contact elements are disconnected, current will be below an arcing threshold.

Another electrical connector assembly of that kind is disclosed in U.S. Pat. No. 8,215,992 B1.

EP 1 284 526 B1 discloses a further solution for a preventing arcing between two main contact elements. The electrical connector assembly comprises a first main contact element and a second main contact element. Further, the electrical connector assembly has one auxiliary contact element which is connected to a relay. The auxiliary contact element comes into contact with one of the main contact elements before the first and second main contact elements are connected to each other while mating the electrical connectors. When the auxiliary contact element comes into contact with one of the main contact elements, a relay is switched, so that electrical power is bypassed avoiding current flowing through the main contact elements. After mating the "cold" first and second main connector elements to each other the auxiliary contact elements are lifted from the main contact element so that the relay is switched back into its initial position and electrical power is led through the main contact elements. When unmating the electrical connector assembly these steps take place in the opposite direction so that the connectors are unmated with cold first and second main contact elements so that arcing is avoided.

Object of the present invention is to provide an electrical connector assembly avoiding arcing between the first and second main contact elements at least while unmating the connectors and at the same time having a simple constructive design.

SUMMARY OF THE INVENTION

The object is solved by an electrical connector assembly comprising a first connector having a first main contact element and a first auxiliary contact element, said first auxiliary contact element being electrically connected to said first main contact element. The electrical connector assembly further comprises a second connector having a second main contact element and a second auxiliary contact element, said second auxiliary contact element being electrically connected to said second main contact element. The first connector and the second connector are mateable in a mating direction parallel to a longitudinal axis of the electrical connector assembly. The first and second main contact elements are configured to disconnect from each other before the first and second auxiliary contact elements disconnect from each other during unmating the first and second connectors, wherein in a fully mated condition the first and second main contact elements are in contact and the first and second auxiliary contact elements are disconnected from each other.

Due to the fact that while unmating the first and second main contact elements the first and second auxiliary contact elements are still in contact to each other no electrical arc occurs between the first and second main contact elements. The whole electrical power is led through the still connected first and second auxiliary contact elements. During the further unmating process the first and second auxiliary contact elements are disconnected from each other. During disconnection of the first and second auxiliary contact elements an electrical arc may occur between the first and second auxiliary contact elements which suffer the whole electrical arc search and are sacrificed. Since the first and second auxiliary contact elements are not the main contact elements bearing the electrical power, when the electrical connector assembly is fully mated, these contact elements (first and second auxiliary contact elements) can be damaged without influencing the overall function of the electrical connector assembly.

Further, in a fully mated condition the first and second auxiliary contact elements are disconnected from each other in order to avoid that the auxiliary contact elements are damaged during transmitting electrical power when fully mated. Hence, any damages in regard to the geometry and plating of the first and second main contact elements is avoided.

The auxiliary contact elements may also be manufactured and designed such, that they are configured to be more robust against high temperature electronic arcs. The auxiliary contacts need not to be design for high conductivity and low resistance as the main contact elements should be design. Hence, the auxiliary contact elements can be protected against damages by electronic arcs more easily than the main contact elements.

Comparable, while mating the first and the second connectors, at first the first and second auxiliary contact elements come into contact to each other. During the connection of the first and second auxiliary contact elements an electrical arc may occur between the auxiliary contact elements without an arc between the first and second main contact elements. After the auxiliary contact elements have been brought into contact to each other the first and second main contact elements are brought into contact to each other. During the connection of the first and second main contact elements with each other no arc will occur due to the electrical connection between the first and second auxiliary contact elements, which is already established when the main contact elements contact each other. In a fully mated condition only the first and second main contact elements are in an electrical connection to each other and in contact to each other while the first and second auxiliary contact elements are disconnected from each other.

In an embodiment of the invention the first and second main contact elements and the first and second auxiliary contact elements are configured such that, in a first partially mated condition of the first and second connectors, the first and second auxiliary contact elements contact each other and the first and second main contact elements are disconnected from each other.

Alternatively or additionally, the first and second main contact elements and the first and second auxiliary contact elements may be configured such that, in a second partially mated condition of the first and second connectors, in which the first and second electrical connectors are mated farther than in the first partially mated condition, the first and second auxiliary contact elements contact each other and the first and second main contact elements contact each other.

Further alternatively or additionally, the first and second main contact elements and the first and second auxiliary contact elements may be configured such that, in a fully mated condition of the first and second connectors, the first and second auxiliary contact elements are disconnected from each other and the first and second main contact elements contact each other.

In an embodiment the first auxiliary contact element is electrically connected to the first main contact element without any intermediate electrical resistor or switch. Alternatively or additionally, the second auxiliary contact element is electrically connected to the second main contact element without any intermediate electrical resistor or switch.

In a further embodiment the first auxiliary contact element and the second auxiliary contact element are electrically connected to the first main contact element and the second main contact element, respectively, without any intermediate electrical component at all. An electrical component is any basic discrete device or physical entity in the electronic system between auxiliary contact elements and the main contact elements used to effect electrons or their associated fields, such as resistors, switches, diodes, transistors, capacitors and the like. Any electricity line, such as wires, cables, terminals or the like, are not considered electronic components.

The first auxiliary contact element may extend farther in the mating direction towards the second connector than the first main contact elements in order to enable that the first auxiliary contact element comes into contact with the second auxiliary contact element before the first and second main contact elements come into contact to each other.

In addition or alternatively, the second auxiliary contact element may extend farther in the mating direction towards the first connector than the second main contact element.

According to an embodiment of the invention the first auxiliary contact element extends substantially parallel and distanced to the first main contact element.

Alternatively or additionally, the second auxiliary contact element may extend substantially parallel and distanced to the second main contact element.

According to an embodiment of the invention it might be provided that the first and second auxiliary contact elements each have a contact portion at a tip end region of the first and second auxiliary contact elements and that the first and second auxiliary contact elements each have a disconnect portion adjacent to the contact portion remote from the tip end of the first and second auxiliary contact elements.

Further, it could be provided that, in a partially mated condition of the first and second connectors, the contact portion of the first auxiliary contact element has a larger radial distance to the first and second main contact elements than the disconnect portion of the second auxiliary contact, and that the contact portion of the second auxiliary contact element has a smaller radial distance to the first and second main contact elements than the disconnect portion of the first auxiliary contact.

In a partially mated condition of the first and second connectors, the contact portions of the first and second auxiliary contact elements overlap each other in longitudinal direction and are in contact to each other, according to an exemplary embodiment.

In a fully mated condition of the first and second connectors, the contact portion of the first auxiliary contact element may overlap with the disconnect portion of the second auxiliary contact element in a longitudinal direction with a radial distance thereto. Further, the contact portion of the second auxiliary contact element may overlap with the disconnect portion of the first auxiliary contact element in longitudinal direction with a radial distance thereto.

Hence, it is enabled that the auxiliary contact elements are disconnected from each other in the fully mated condition of the first and second connectors.

The first and second auxiliary contact elements each may have a connection portion opposite to the tip ends connected to the first and second main contact elements, respectively.

BRIEF DESCRIPTION OF THE DRAWINGS

The invention will now be described by way of example with reference to the accompanying Figures, wherein.

DETAILED DESCRIPTION OF THE INVENTION

Figure 1:
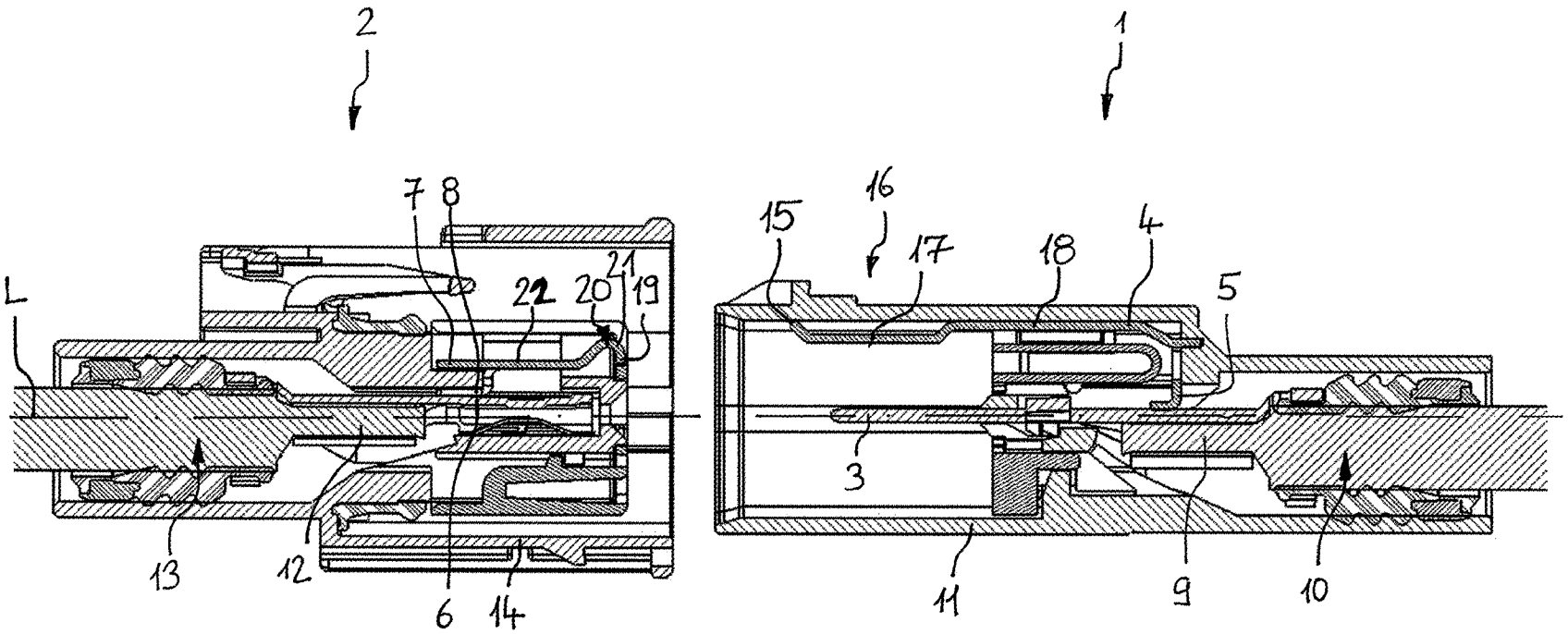
FIG. 1 is a longitudinal sectional view of an electrical connector assembly having a first connector and a second connector in an unmated condition.

FIGS. 1 to 4 depict an exemplary embodiment of the present invention in different positions. The electrical connector assembly comprises a first connector 1 and a second connector 2 which are mateable in a mating direction parallel to a longitudinal axis L. The mating direction is a direction of the first connector 1 and the second connector 2 towards each other along the longitudinal axis L.

The first connector 1 comprises a first main contact element 3 and a first auxiliary contact element 4. The first auxiliary contact element 4 is electrically connected to the first main contact element 3. For this purpose the first auxiliary contact element 4 has a first connection portion which is in contact to the first main contact element 3. Both, the first main contact element 3 and the first auxiliary contact element 4 are made of an electrical conductive material. Between the first main contact element 3 and the first auxiliary contact element 4 no intermediate electrical resistor or switch is arranged. Between the first main contact element 3 and the first auxiliary contact element 4, preferably, no electrical component at all is arranged.

The second connector 2 comprises a second main contact element 6 and a second auxiliary contact element 7, both made of an electrically conductive material. The second auxiliary contact element 7 is electrically connected to the second main contact element 6. For this reason, the second auxiliary contact element 7 has a second connection portion 8 which is held in contact to the second main contact element 6 for establishing an electrical connection. Between the second main contact element 6 and the second auxiliary contact element 7 no electrical resistor or switch is provided. Between the second main contact element 6 and the second auxiliary contact element 7, preferably, no electrical component at all is provided.

The first main contact element 3, in this example, is a male terminal. The first main contact element 3 is electrically connected to a conductor 9 of a first cable 10. The first main contact element 3 is locked within a first housing 11 wherein the first housing 11 is preferably made of an electrically insulating material, such as synthetic resin.

The second main contact element 6 is a female terminal and is electrically connected to a conductor 12 of a second cable 13. The second main contact element 6 is secured within a second housing 14 made of an electrically insulating material, such as synthetic resin.

Figure 4:
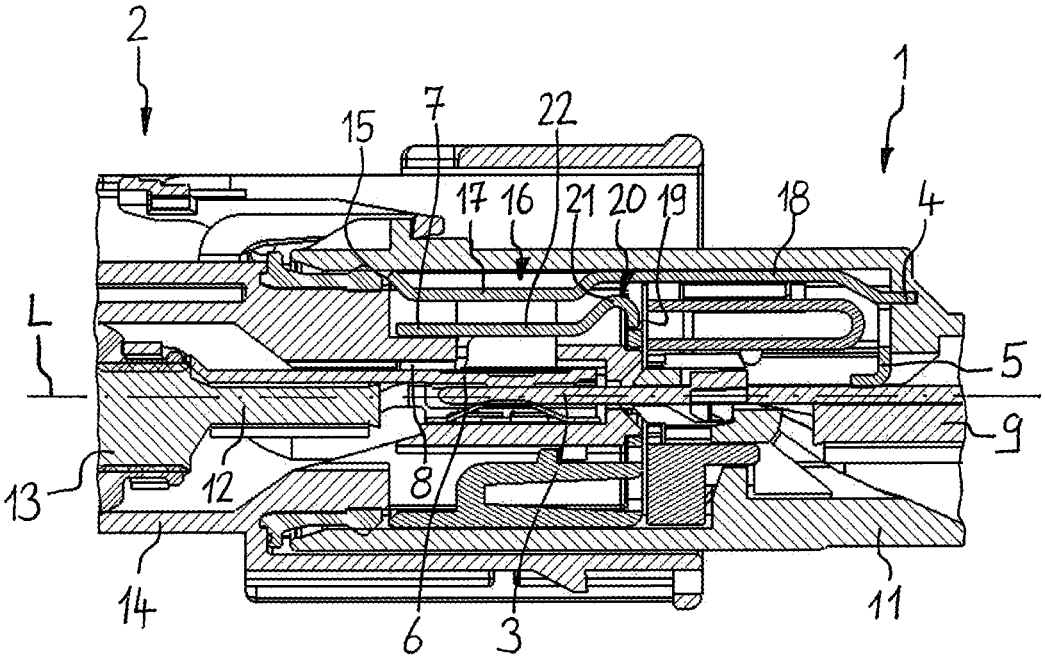
FIG. 4 is a longitudinal sectional view of the electrical connector assembly as of FIG. 1 with the first connector and the second connector in a fully mated condition.

The first and second auxiliary contact elements 4, 7 are configured to contact each other before the first and second main contact elements 3, 6 contact each other when the first and second connectors 1, 2 are mated, starting from the unmated condition as disclosed in FIG. 1 until reaching the fully mated condition in FIG. 4. In the fully mated condition (FIG. 4) the first and second main contact elements 3, 6 are in contact to each other establishing an electrical connection therebetween, while the first and second auxiliary contact elements 4, 7 are disconnected from each other, avoiding an electrical connection between the first and second auxiliary contact elements 4, 7.

In the unmated condition according to FIG. 1 neither the first and second main contact elements 3, 6 nor the first and second auxiliary contact elements 4, 7 are in contact to each other.

Figure 2:
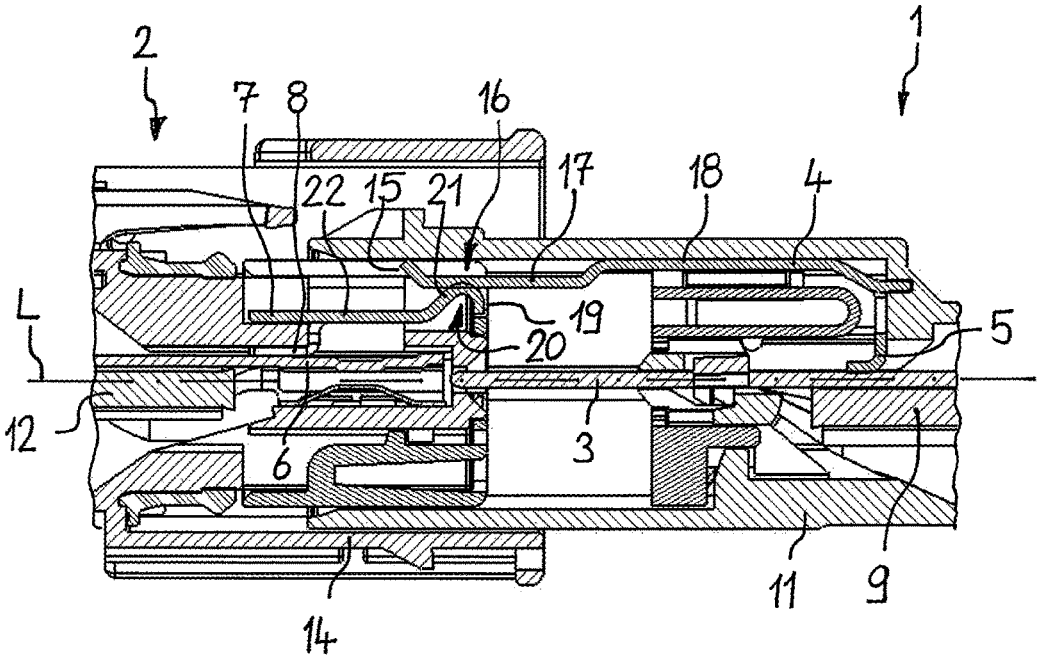
FIG. 2 is a longitudinal sectional view of the electrical connector assembly as of FIG. 1 with the first connector and the second connector in a first partially mated condition.
Figure 3:
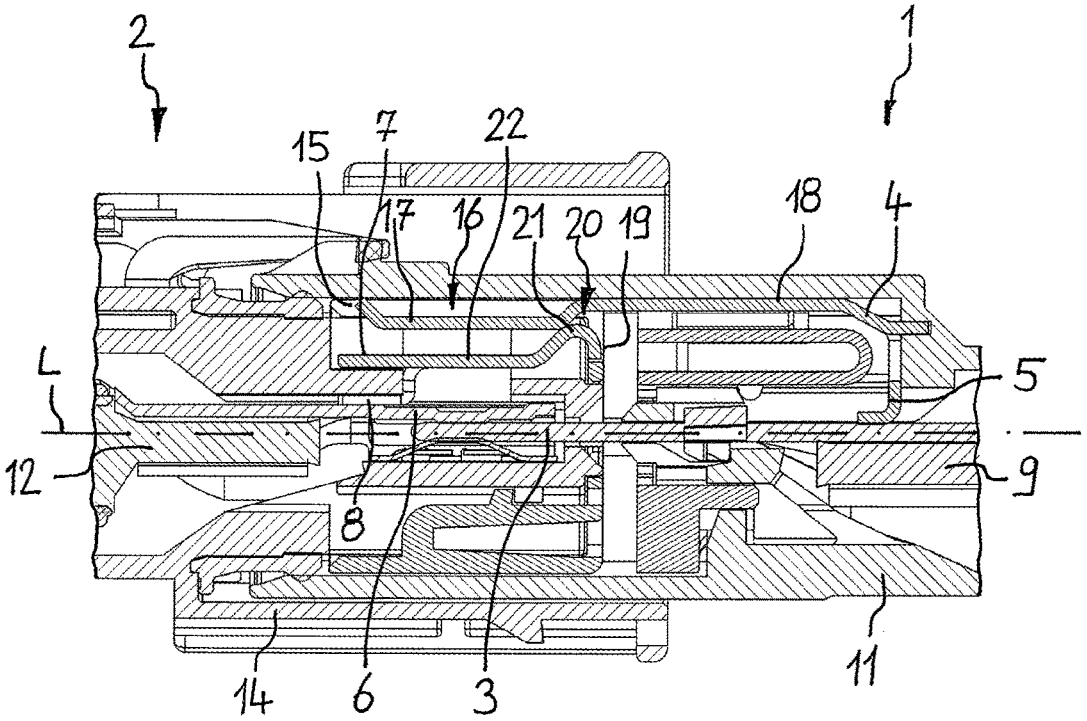
FIG. 3 is a longitudinal sectional view of the electrical connector assembly as of FIG. 1 with the first connector and the second connector in a second partially mated condition.

In a first partially mated condition of the first and second connectors 1, 2, as shown in FIG. 2, the first auxiliary contact element 4 and the second auxiliary contact element 7 are in contact to each other establishing an electrical connection between them. At the same time the first main contact element 3 and the second main contact element 6 are still disconnected from each other avoiding an electrical connection therebetween. Further, the first and second main contact elements 3, 6 are arranged at a distance to each other which is sufficient to avoid an electrical arc between the first and second main contact elements 3, 6. Hence, during the mating process starting from the unmated condition according to FIG. 1 to the first partially mated condition according to FIG. 2 an electrical arc may only occur between the first and second auxiliary contact elements 4, 7. In the first partially mated condition according to FIG. 2 all the electrical power is guided through the first and second auxiliary contact elements 4, 7 so that during the further mating process an arc between the first and second main contact elements 3, 6 is avoided. The first and second main contact elements 3, 6 come into contact to each other establishing an electrically connection therebetween according to FIG. 3 without any electrical arcing therebetween. In the second partially mated condition as disclosed in FIG. 3 the first and second main contact elements 3, 6 are in contact to each other as well as the first and second auxiliary contact elements 4, 7. The electrical power is transmitted through all of the contact elements 3, 4, 6, 7.

In order to provide small first and second auxiliary contact elements 4, 7 they are not configured such that they can bear the entire electrical power over a longer time. Therefore, in a fully mated condition, as disclosed in FIG. 4, the first and second auxiliary contact elements 4, 7 are disconnected from each other while the first and second main contact elements 3, 6 are kept in contact to each other. Hence, the entire electrical power is transmitted only via the first and second main contact elements 3, 6.

The exemplary embodiment according to the Figures shows one possible configuration of the first and second auxiliary contact elements 4, 7. The first auxiliary contact element 4 extends at least substantially parallel and in radial distance to the first main contact element 3, both of which are arranged at least substantially parallel to the longitudinal axis L. The radial direction refers to the longitudinal axis L.

Comparable to the first auxiliary contact element 4, the second auxiliary contact element 7 extends at least substantially parallel to the second main contact element 6 in a radial distance thereto.

The first auxiliary contact element 4 extends farther in the mating direction towards the second connector 2 than the first main contact element 3. Further, the second auxiliary contact element 7 extends farther in the mating direction towards the first connector 1 than the second main contact element 6.

Hence, while mating the first and the second connectors 1, 2 the first and second auxiliary contact elements 4, 7 come in contact first before the first and second main contact elements 3, 6 are contacted to each other. Or in other words, while unmating the first and the second connectors 1, 2 the first and second main contact elements 3, 6 disconnect from each other first before the first and second auxiliary contact elements 4, 7 are disconnected from each other.

This, however, can also be achieved in a different manner. It is also possible that only one of the first and second auxiliary contact elements 4, 7 extends farther towards the other connector 1, 2 than the respective main contact element 3, 6. It is important, however, that in an unmated condition, in which the first and second connectors 1, 2 are aligned to each other along the longitudinal axis L for being mated by moving at least one of the two connectors 1, 2 towards the other connector 1, 2, a first distance between the first auxiliary contact element 4 and the second auxiliary contact element 7 is smaller than a second distance between the first main contact element 3 and the second main contact element 6. In addition, the amount the second distance is larger than the first distance is sufficient in order to avoid an arcing between the first and second main contact elements 3, 6 in a position in which the initial contact is established between the first and second auxiliary contact element 4, 7 while mating the connectors 1, 2.

The first auxiliary contact element 4 extends in a longitudinal direction towards the second connector 2 and terminates in a tip end 15. In a tip end region 16 the first auxiliary contact element 4 has a contact portion 17. Adjacent to the contact portion 17 the first auxiliary contact element 4 has a disconnect portion 18.

The second auxiliary contact element 7 extends in a longitudinal direction towards the first connector 1 and terminates in a tip end 19. At a tip end region 20 the second auxiliary contact element 7 has a contact portion 21 adjacent to which a disconnection portion 22 is located.

In a radial direction the contact portion 17 of the first auxiliary contact element 4 is located nearer to the first main contact element 3 than the disconnect portion 18. In addition, the contact portion 21 of the second auxiliary contact element 7 has a greater distance to the second main contact element 6 than the disconnect portion 22 of the second auxiliary contact element 7.

The contact portion 17 of the first auxiliary contact element 4 has a smaller distance to the longitudinal axis L than the contact portion 21 of the second auxiliary contact element 7. The longitudinal axis L, in this case, extends through the first and second main contact elements 3, 6. Further, the first and second connectors 1, 2 are in a position to each other, in which the first and second connectors 1, 2 are aligned to each other to the longitudinal axis L so that the first and second connectors 1, 2 could be mated in a mating direction parallel to the longitudinal axis L. This configuration facilitates a contact between the contact portion 17 of the first auxiliary contact element 4 and the contact portion 21 of the second auxiliary contact element 7 while mating the first and the second connectors 1, 2.

Further, again provided that the longitudinal axis L extends through the first and second main contact element 3, 6, the radial distance of the contact portion 17 of the first auxiliary contact element 4 to the longitudinal axis L is larger than the radial distance of the disconnect portion 22 of the second auxiliary contact element 7 to the longitudinal axis L. Further, the radial distance of the disconnect portion 18 of the first auxiliary contact element 4 to the longitudinal axis L is larger than the radial distance of the contact portion 21 of the second auxiliary contact element 7 to the longitudinal axis L. By this, it is facilitated that in the fully mated condition the first and the second auxiliary contact elements 4, 7 are disconnected from each other.

In the first and second partially mated condition of the first and second connectors 1, 2 the contact portions 17, 21 of the first and second auxiliary contact elements 4, 7 overlap each other in longitudinal direction and are in contact to each other establishing an electrical connection therebetween.

In a fully mated condition of the first and second connectors 1, 2 the contact portion 17 of the first auxiliary contact element 4 overlaps, in a longitudinal direction, the disconnect portion 22 of the second auxiliary contact element 7 with a radial distance therebetween. Further, in the fully mated condition of the first and second connectors 1, 2, the contact portion 21 of the second auxiliary contact element 7 overlaps, in a longitudinal direction, the disconnect portion 18 of the first auxiliary contact element 4 with a radial distance therebetween.

It shall be noted that, although only one pair of main contact elements, i.e. the first and second main contact elements 3, 6, and only one pair of auxiliary contact elements, i.e. the first and second auxiliary contact elements 4, 7, are describe in the embodiment, the connector assembly according to the invention may have a plurality of pairs of main contact elements and/or a plurality of pairs of main contact elements.

REFERENCE NUMERALS LIST

1 first connector
2 second connector
3 first main contact element
4 first auxiliary contact element
5 first connection portion
6 second main contact element
7 second auxiliary contact element
8 second connection portion
9 conductor
10 first cable
11 first housing
12 conductor
13 second cable
14 second housing
15 tip end (of first auxiliary contact element)
16 tip end region (of first auxiliary contact element)
17 contact portion (of first auxiliary contact element)
18 disconnect portion (of first auxiliary contact element)
19 tip end (of second auxiliary contact element)
20 tip end region (of second auxiliary contact element)
21 contact portion (of second auxiliary contact element)
22 disconnect portion (of second auxiliary contact element)
L longitudinal axis

The invention claimed is:

1. An electrical connector assembly comprising:

a first connector having a first main contact element and a first auxiliary contact element, said first auxiliary contact element being electrically connected to said first main contact element, a second connector having a second main contact element and a second auxiliary contact element, said second auxiliary contact element being electrically connected to said second main contact element, wherein the first connector and the second connector are mateable in a mating direction parallel to a longitudinal axis L of the electrical connector assembly, wherein the first and second main contact elements are configured to disconnect from each other before the first and second auxiliary contact elements dis-connect from each other during unmating the first and second connectors, wherein in a fully mated condition the first and second main contact elements are in contact and the first and second auxiliary contact elements are disconnected from each other wherein the first auxiliary contact element extends at least substantially parallel and radially distanced to the first main contact element, and wherein the second auxiliary contact element extends at least substantially parallel and radially distanced to the second main contact element.

2. The electrical connector according to claim 1, wherein the first and second main contact elements and the first and second auxiliary contact elements are configured such:

that in a first partially mated condition of the first and second connectors, the first and second auxiliary contact elements contact each other and the first and second main contact elements are disconnected from each other, wherein in a second partially mated condition of the first and second connectors, in which the first and second connectors are mated farther than in the first partially mated condition, the first and second auxiliary contact elements contact each other and the first and second main contact elements contact each other, and that in a fully mated condition of the first and second connectors, the first and second auxiliary contact elements are disconnected from each other and the first and second main contact elements contact each other.

3. The electrical connector according to claim 1, wherein the first auxiliary contact element is electrically connected to the first main contact element without any intermediate electrical resistor or switch, and wherein the second auxiliary contact element is electrically connected to the second main contact element without any intermediate electrical resistor or switch.

4. The electrical connector according to claim 1, wherein the first auxiliary contact element extends farther in the mating direction towards the second connector than the first main contact element.

5. The electrical connector according to claim 1, wherein the second auxiliary contact element extends farther in the mating direction towards the first connector than the second main contact element.

6. The electrical connector according to claim 1, wherein the first and second auxiliary contact elements each have a contact portion at a tip end region of the first and second auxiliary contact elements and wherein the first and second auxiliary contact elements each have a disconnect portion adjacent to the contact portions remote from the tip ends of the first and second auxiliary contact elements, respectively.

7. The electrical connector according to claim 6, wherein in a partially or fully mated condition of the first and second connectors the contact portion of the first auxiliary contact element has a larger radial distance to the first and second main contact elements than the disconnect portion of the second auxiliary contact, and wherein the contact portion of the second auxiliary contact element has a smaller radial distance to the first and second main contact elements than the disconnect portion of the first auxiliary contact.

8. The electrical connector according to claim 1, wherein in a partially mated condition of the first and second connectors the contact portions of the first and second auxiliary contact elements overlap each other in longitudinal direction and are in contact to each other.

9. The electrical connector according to claim 1, wherein in a fully mated condition of the first and second connectors the contact portion of the first auxiliary contact element overlaps, in longitudinal direction, the disconnect portion of the second auxiliary contact element with a radial distance thereto, and wherein in the fully mated condition of the first and second connectors the con-tact portion of the second auxiliary contact element overlaps, in longitudinal direction, the disconnect portion of the first auxiliary contact element with a radial distance thereto.

10. The electrical connector according to claim 1, wherein the first and second auxiliary contact elements each have a connection portion opposite to tip ends connected to the first and second main contact elements, respectively.

11. An electrical connector assembly comprising:

a first connector having a first main contact element and a first auxiliary contact element, said first auxiliary contact element being electrically connected to said first main contact element; and a second connector having a second main contact element and a second auxiliary contact element, said second auxiliary contact element being electrically connected to said second main contact element, wherein the first connector and the second connector are mateable in a mating direction parallel to the longitudinal axis L of the electrical connector assembly, and wherein the first and second main contact elements are configured to disconnect from each other before the first and second auxiliary contact elements disconnect from each other during unmating the first and second connectors, wherein in a fully mated condition the first and second main contact elements are in contact with the first and second auxiliary contact elements are disconnected from each other, and wherein the first and second auxiliary contact elements each have a contact portion at a tip end region of the first and second auxiliary contact elements and wherein the first and second auxiliary contact elements each have a disconnect portion adjacent to the contact portions remote from the tip ends of the first and second auxiliary contact elements, respectively.

* * * * *